United States Patent [19]

Aoki et al.

[11] Patent Number: 4,712,385

[45] Date of Patent: Dec. 15, 1987

[54] REFRIGERATING UNIT FOR VENDING MACHINE

[75] Inventors: Kazumi Aoki, Gunma; Minoru Fujiu, Omama, both of Japan

[73] Assignee: Sanden Corporation, Gunma, Japan

[21] Appl. No.: 868,141

[22] Filed: May 29, 1986

[30] Foreign Application Priority Data

May 31, 1985 [JP] Japan ..... 60-80809[U]

[51] Int. Cl.[4] ..... F25D 17/00

[52] U.S. Cl. ..... 62/333; 62/335; 62/513; 62/113

[58] Field of Search ..... 62/199, 113, 513, 504, 62/498, 511, 333, 335, 378

[56] References Cited

U.S. PATENT DOCUMENTS 4,285,205 8/1981 Martin et al. ..... 62/199

*Primary Examiner*—Henry Bennett

*Attorney, Agent, or Firm*—Banner, Birch, McKie & Beckett

[57] ABSTRACT

A refrigerating unit suitable for use in a vending machine which is provided with a plurality of isolated chambers for storing the different types of merchandise comprises a condensing unit which includes compressor and condenser, with two parallel connected evaporators each evaporator being disposed in one isolated chamber of the vending machine and connected with the condensing unit through a suction and a discharge lines, and a capillary tube is inserted on suction side of each evaporator. Therefore, two refrigerant circuits are provided. A part of each suction line of one refrigerant circuit is closely disposed to extend along the capillary tube of the other refrigerant circuit. Thereby operation of one refrigerant circuit is directly controlled by the operating conditions of other refrigerant circuit.

3 Claims, 2 Drawing Figures

REFRIGERATING UNIT FOR VENDING MACHINE

BACKGROUND OF THE INVENTION

This invention relates to a refrigerating unit for cooling down a plurality of chambers by utilizing one refrigerating compressor, and more particularly, to a refrigerating unit suitable for use in a vending machine provided with a plurality of isolated storage chambers.

Generally, the vending machine stores different types of beverages and/or merchandise to meet the consumer's taste demands. However, these beverages and/or merchandise should be stored under predetermined temperatures to hold the flavor thereof or to maintain the freshness thereof. The predetermined temperature is determined by the characteristics of each beverage and/or merchandise item. Therefore, each chamber of the vending machine in which different type of beverages and/or merchandise are stored should be maintained at different temperatures, but the temperature in each chamber is generally maintained by operation of one refrigerating unit to reduce the cost and dead space of the vending machine.

Referring to FIG. 1, a prior art refrigerating unit for a vending machine is illustrated. The refrigerating unit 1 comprises a compressor 2, a condenser 3 and two evaporators 4*a* and 4*b*, each of which evaporators is disposed in an isolated chamber of the vending machine, respectively. The evaporators 4*a* and b are parallel connected with one another, and magnetic valves 5*a* and 5*b*, and capillary tubes 6*a* and 6*b* which are serially connected with one another are disposed between condenser 3 and each evaporator 4*a* and 4*b* to control the flow of refrigerant. Suction lines 7*a* and 7*b* which are connected between the suction port of compressor 2 and each evaporator 4*a* and 4*b* are closely disposed relative to capillary tubes 6*a* and 6*b* to accomplish heat exchange therebetween.

In the operation of refrigerating unit 1, the high temperature and high pressure refrigerant discharged from compressor 2 is condensed by condenser 3, and is then separated into two systems to flow in both evaporators 4*a* and 4*b*. Before flowing into evaporators 4*a* and 4*b*, the refrigerant passes through capillary tubes 6*a* and 6*b* and heat exchanged with the air passed through evaporator 4*a* and 4*b*. Thus, each isolated chamber of the vending machine in which evaporator 4*a* and 4*b* are disposed is refrigerated. Vaporized refrigerant is returned to the compressor through suction lines 7*a* and 7*b* while exchanging heat with capillary tubes 6*a* and 6*b*.

In this construction of the refrigerating unit, control of operation of either one of refrigerant circuits is accomplished by open-close operation of magnetic valve 5*a* and 5*b* even if compressor 2 is continuously driven. Therefore, one of the isolated chambers is refrigerated in the normal way and the other chamber is maintained at normal temperature. On the other hand, if two isolated chambers of a vending machine should be maintained at different temperatures in accordance with the stored merchandise, i.e., the cooling load of each chamber is different, temperature control in each chamber is generally accomplished by determination of the rate between constriction of the area of the two capillary tubes 6*a* and 6*b*. That is the amount of refrigerant flowing into each evaporator 4*a* and 4*b* can be controlled by change of the constriction area of capillary tubes 6*a* and 6*b*, and finally the chambers of the refrigerating vending machine are maintained at different temperatures, respectively.

However, the stored amount of merchandise within each isolated chamber directly changes the refrigerating load of the chamber. Therefore, if the refrigerating load in each chamber is changed, for example, the refrigerant in one of the chambers in which first evaporator 4a is disposed is increased and the refrigerating load, in the other chamber in which the second evaporator 4*b* is disposed, is decreased, the amount of refrigerant flowed into first evaporator 4*a* is insufficient and overheated refrigerant is passed through suction line 7*a*. Therefore, the temperature on the outer surface of suction line 7*a* is increased. On the other hand, the evaporation of refrigerant passing through the second evaporator 4*b* is insufficient, therefore, gas-liquid mixed refrigerant is passed through the suction line. Thus, the outer surface of suction line 7*b* is cooled down by this mixed refrigerant.

Furthermore, if the outer surface of the capillary tube is normally cooled down in a conventional way, the amount of flash gas generated within the capillary tube is reduced, to thereby reduce the flow inlet resistance of the refrigerant, and also maintain the liquid refrigerant at a lower temperature and lower pressure. On the other hand, if the temperature on the outer surface of the capillary tube is increased by external environmental factors or the capillary tube is left alone without cooling, the amount of flash gas is increased. Thus, the flow inlet resistance of refrigerant is increased, to thereby impede the smooth flow of refrigerant.

Therefore, when suction lines 7*a* and 7*b* are closely disposed relative to the evaporator of its refrigerant circuit, the temperature condition of suction lines 7*a* and 7*b* are directly influenced by the operating conditions of capillary tubes 6*a* and 6*b*. Thus, the phenomenon in each refrigerant circuit is increased, i.e., insufficient refrigerant in one circuit and over cooling in the other circuit occurs. As a result of this phenomenon, liquid refrigerant partially flows into one of the evaporators, and causes unbalanced refrigerating operation of the refrigerating unit.

SUMMARY OF THE INVENTION

It is a primary object of this invention to provide an improved refrigerating unit for use in a vending machine wherein a plurality of chambers within the vending machine are formed for storage of different types of merchandise, the unit being effectively refrigerated by a single compressor.

It is another object of this invention to provide a refrigerating unit for use in a vending machine wherein the environmental conditions in each chamber are easily detected and used as a control factor therefor.

It is still another object of this invention to provide a refrigerating unit for use in a vending machine which is easily utilized in prior vending machines with simple modification.

A refrigerating unit for use in a vending machine in accordance with this invention comprises a condensing unit including a compressor and a condenser, two parallel connected evaporators communicate with the condensing unit through discharge and suction lines to form two refrigerant circuits and a decompression device is disposed on the flow inlet portion of each evaporator. The suction line of one refrigerant circuit is partially placed closely disposed to the decompression device of the other refrigerant circuit.

Further objects, features and other aspects of this invention will be understood from the detailed description of the preferred embodiment of this invention while referring to the annexed drawings.

DETAILED DESCRIPTION OF PREFERRED EMBODIMENT

Figure 1:
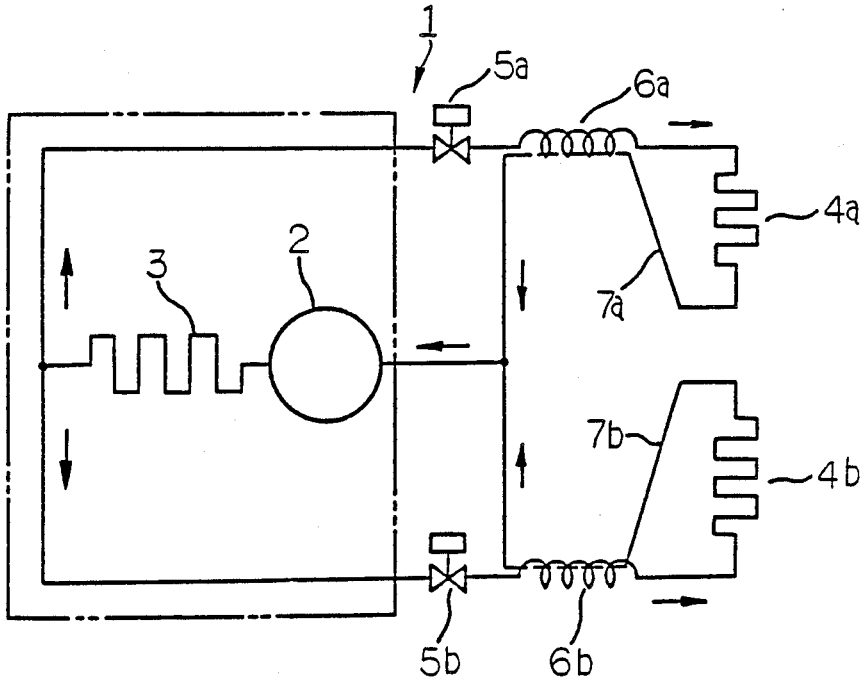
FIG. 1 PRIOR ART
FIG. 1 is a diagramatic view of a prior art refrigerating unit.
Figure 2:
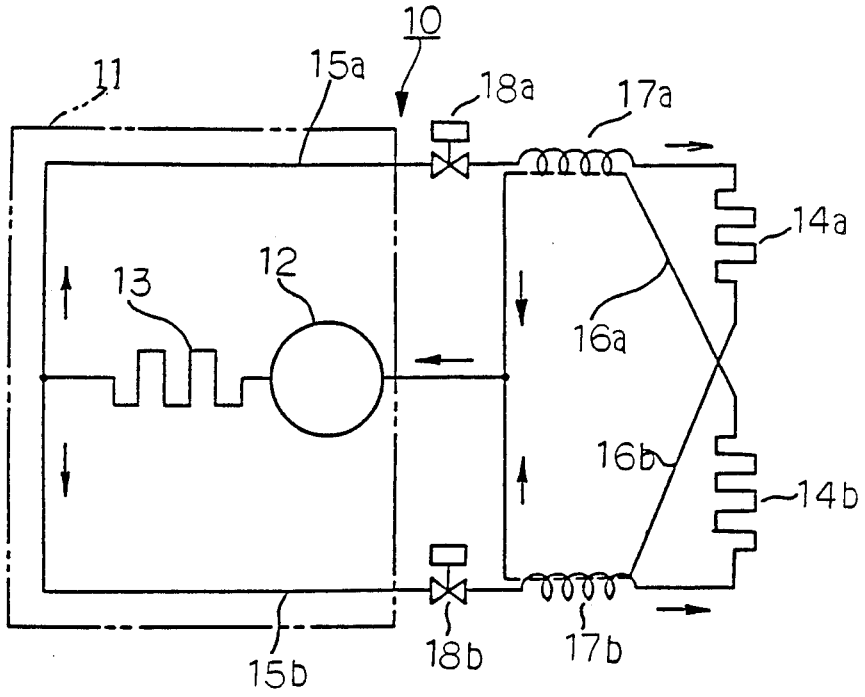
FIG. 2 is a diagramatic view of a refrigerating unit according to one embodiment of this invention.

Referring to FIG. 2, a refrigerating unit 10 suitable for use in a vending machine in accordance with this invention is shown. The refrigerating unit 10 includes a condensing unit 11 which comprises a single compressor 12 and a condenser 13. Two evaporators 14*a* and 14*b* are parallel connected with one another and connected with condensing unit 11 through discharge lines 15*a* and 15*b*, and suction lines 16*a* and 16*b*, respectively, to form two refrigerant circuits.

Each evaporator 14*a* and 14*b* is disposed within an isolated chamber of the vending machine (not shown) which is formed as storage chambers for merchandise, respectively. Therefore, each isolated chamber is refrigerated by operation of evaporators 14*a* and 14*b*.

A decompression device, such as capillary tubes 17*a* and 17*b*, is disposed on the suction side of evaporators 14*a* and 14*b*, respectively, and also a magnetic valve 18*a* and 18*b* may be disposed in each of discharge lines 15*a* and 15*b*, respectively, to control the operation of the evaporators. Part of each suction line 16*a* and 16*b* passes closely adjacent to capillary tubes 17*a* and 17*b* of the other refrigerant circuit to accomplish the heat exchanging operation therebetween, i.e., first suction line 16*a* is connected between the suction port of condensing unit 11 and evaporator 14*b* with this line partially passing adjacent capillary tube 17*a*. Likewise, suction line 16*b* is partly passed adjacent second capillary tube 17*b* which is communicated with evaporator 14*a*. Second suction line 16*b* is connected between the suction port of compressor 11 and the second evaporator 14*a*.

In this construction, when either one of the isolated chambers is maintained at normal temperature, either one of magnetic valves 18*a* or 18b should be closed. The flow of refrigerant into one of the refrigerant circuits which is disposed in the chamber having normal temperature is interrupted. In this situation, the capillary tube through which the refrigerant is passed cannot be cooled down by the suction line of other refrigerant circuit. However, the refrigerant only flows into one of the evaporators through the magnetic valve and capillary tube. Thus, the capacity of either one of the refrigerant circuits is determined by the configuration of the capillary tube.

On the other hand, when two isolated chambers of the vending machine are refrigerated by refrigerating unit 10, the operation of the capillary tubes is influenced by the condition of the suction line of the other refrigerant circuit, to thereby automatically maintain balance of the circulating amount of refrigerant in each refrigerant circuit. Thus, each capillary tube 17*a* and 17*b* is directly influenced by the operating condition of the other refrigerant circuit through suction lines 16*a* and 16*b*. For instance, when the refrigerating load of the first refrigerant circuit is decreased due to change in the stored amount of merchandise in each isolated chamber, the refrigerant passed through the first refrigerant circuit is insufficient and the refrigerant of the second refrigerant circuit is exceeded.

As a result of above mentioned situation, suction line 16*a* is heated by superheated gas and, suction line 16*b* is cooled by insufficient evaporated refrigerant. At that time, suction line 16*a* partly passes along capillary tube 17*a* and suction line 16*b* partly passes along capillary tube 17*b*. Therefore, the heat on suction line 16*a* is transferred to second capillary tube 17*a* and the cooling in the suction line 16*b* is transferred to capillary tube 17*b*. Thus, capillary tube 17*b* is cooled down by suction line 16*b*, to thereby increase the amount of refrigerant flow into first evaporator 14*b*. Also, capillary tube 17*a* is heated by first suction line 16*a*, to thereby decrease the amount of refrigerant flow into second evaporator 14*a*. In this manner of operation, the required capacity of each refrigerant circuit is maintained.

This invention has been described in detail in connection with a preferred embodiment, but this is to be recognized as an example only and the invention is not restricted thereto. It will be easily understood by those skilled in the art that other variations and modifications can be easily made within the scope of this invention as claimed.

We claim:

1. A refrigerating unit for use in a vending machine comprising a condensing unit including a single compressor and a condenser, two parallel connected evaporators, each evaporator being disposed in an isolated chamber of the vending machine and each evaporator being connected with said condensing unit through a discharge line and a suction line to form two refrigerant circuits, and a decompression device inserted in the suction side portion of each evaporator, the improvement comprising said suction lines being connected between said compressor and said evaporators, and said evaporator of one refrigerant circuit having a portion of its discharge line passing closely adjacent in heat exchange relation with said decompression device on the other refrigerant circuit to maintain balance of the circulating amount of refrigerant in each of said refrigerant circuits.

2. The refrigerating unit for use in a vending machine of claim 1 wherein said decompression device is a capillary tube.

3. The refrigerating unit for use in a vending machine of claim 1 wherein a magnetic valve means is inserted in each said discharge line which is connected between said condenser of said condensing unit and said evaporator, respectively.

* * * * *